United States Patent [19]

Hafer et al.

[11] 4,236,834

[45] Dec. 2, 1980

[54] ELECTROTHERMAL PRINTING APPARATUS

[75] Inventors: Cameron H. Hafer; Clayton V. Wilbur, both of San Jose, Calif.

[73] Assignee: International Business Machines Corporation, Armonk, N.Y.

[21] Appl. No.: 946,710

[22] Filed: Sep. 28, 1978

[51] Int. Cl.[3] ..... B41J 3/04

[52] U.S. Cl. ..... 400/120; 346/76 R

[58] Field of Search ..... 400/118, 119, 120, 121, 400/, 237, 241.1; 346/76 R, 76 L, 135, 162, 163; 219/216

[56] References Cited

U.S. PATENT DOCUMENTS

| | | | |
|---|---|---|---|
| 3,419,886 | 12/1968 | Ortlieb | 400/120 |
| 3,441,940 | 4/1969 | Salaman et al. | 346/135 X |
| 3,632,970 | 1/1972 | Walkow et al. | 219/216 |
| 3,637,976 | 1/1972 | Ohta et al. | 219/216 |
| 3,719,261 | 3/1973 | Heinzer et al. | 400/120 |
| 3,739,087 | 6/1973 | Metcalfe et al. | 346/162 |
| 3,744,611 | 7/1973 | Montanari et al. | 400/120 |
| 3,787,873 | 1/1974 | Sato et al. | 346/76 LX |
| 3,848,720 | 11/1974 | Carlsen | 400/120 |
| 3,951,247 | 4/1976 | Montanari | 400/120 |
| 3,967,092 | 6/1976 | Conta et al. | 346/76 PHX |
| 3,978,494 | 8/1976 | Noker | 219/216 X |
| 3,984,844 | 10/1976 | Tanno et al. | 346/76 PH |
| 3,989,131 | 11/1976 | Knirsch et al. | 400/120 |
| 4,030,408 | 6/1977 | Miwa | 400/120 X |
| 4,056,822 | 11/1977 | Thornburg et al. | 346/76 R |
| 4,103,066 | 7/1978 | Brooks et al. | 400/118 X |

OTHER PUBLICATIONS

IBM Technical Disclosure Bulletin, "Electrical and Mechanical Mechanism for Thermal Transfer Printing", Mitchell et al., vol. 18, No. 8, Jan. 1976.

IBM Technical Disclosure Bulletin, "Thermal Transfer Printer Employing Special Ribbons Heated with a Current Pulse", Mitchell et al., vol. 18, No. 8, Jan. 1976, p. 2695.

IBM Technical Disclosure Bulletin, "Resistive Ribbon Thermal Transfer Printing Method", Crooks et al., vol. 19, No. 11, Apr. 1977, p. 4396.

*Primary Examiner*—Ernest T. Wright, Jr.

*Attorney, Agent, or Firm*—John P. Scherlacher; Otto Schmid, Jr.

[57] ABSTRACT

Electrothermal printing apparatus includes a thin, planar, endless ribbon of electrically resistive material having a thin conductive layer on an outside surface thereof and a row of spaced-apart, conductive styli individually selectively coupleable to the conductive layer through a voltage source and disposed in contact with the ribbon at the inside surface thereof opposite the conductive layer. Momentarily coupling selected ones of the styli to the voltage source produces heating of discrete areas of the resistive ribbon adjacent the momentarily coupled styli. The ribbon which is mounted on one or more rollers moves relative to the styli and in the same direction and at the same speed as an adjacent length of thermally sensitive paper so that discrete areas of the ribbon heated by the styli remain in contact with the thermally sensitive paper long enough to color discrete areas of the paper adjacent the heated discrete areas of the resistive ribbon.

14 Claims, 4 Drawing Figures

ELECTROTHERMAL PRINTING APPARATUS

BACKGROUND OF THE INVENTION

1. Field of the Invention

The present invention relates to electrothermal printing apparatus in which printing is effected by momentarily heating selected portions of a heat sensitive medium, and more particularly to arrangements in which characters and other indicia are printed on thermally sensitive paper by imparting heat to the paper via an array of heads or other energizable elements movable relative to the paper.

2. History of the Prior Art

Electrothermal printing apparatus in which one or more heads or other elements are momentarily heated to heat selected areas of an adjacent thermally sensitive paper or other thermally sensitive medium which discolors in response to the heat to effect printing is well known in the art. In typical arrangments of this type a row of side-by-side heads is often provided for sweeping movement relative to the thermally sensitive paper to effect printing of characters or other indicia in dot matrix fashion. The individual heads typically consist of small resistive elements which must be heated to a temperature high enough to color the paper to the desired degree of resolution. At the same time heating of the head must be done relatively quickly so that only a discrete localized area of the paper is colored as the paper continues to move relative to the heads. Examples of this type of printing apparatus are provided by U.S. Pat. No. 3,951,247 to Montanari, ELECTROTHERMAL PRINTING UNIT, issued Apr. 20, 1976, U.S. Pat. No. 3,989,131 to Knirsch et al, ELECTROTHERMAL PRINTING UNIT, issued Nov. 2, 1976, and U.S. Pat. No. 3,967,092 of Conta et al, ELECTROTHERMAL PRINT HEAD, issued June 29, 1976.

Conventional electrothermal printing units have been found to involve a number of problems in their design and operation. One such problem stems from the fact that the growing need for greater resolution requires smaller heads which can be heated to higher temperatures over shorter periods of time. The rapid heating of the relatively small heads to relatively high temperatures produces the requisite resolution and printing speed but at the expense of greatly shortened head life as the resistive heating elements within the heads deteriorate quickly. A further problem which greatly shortens head life results from the fact that the heads must usually be maintained in physical contact with the thermally sensitive paper to provide the desired resolution. The surface of such paper tends to be rather abrasive, resulting in premature head wear.

Problems of this type have led to consideration of alternative approaches such as where the electrically resistive heating elements are combined into a single ribbon or like member heated at selected areas by an arrangement of energizable electrodes. Such arrangements typically utilize a meltable or otherwise thermally sensitive layer of ink or other coloring material imposed on a surface of the resistive ribbon so as to melt and impart color to a contacting piece of paper. Printing arrangements of this type avoid some of the severe head wear problems present in other types of systems but at the expense of certain problems of their own, not the least of which is the rather poor resolution that often results from the extreme difficulty in heating a small and well defined portion of the ink to a selected degree.

Aside from the rather complex ribbon configuration which results from the presence of an ink layer in addition to electrically resistive and conductive layers, such arrangements are frequently incapable of localizing the heating to a small discrete area of the ribbon or of heating different areas of the ribbon uniformly. An example of an arrangement which attempts to solve this type of problem by providing each head with a pair of uniform, closely spaced electrodes is provided by U.S. Pat. No. 3,744,611 of Montanari et al, ELECTRO-THERMIC PRINTING DEVICE, issued July 10, 1973.

Other examples of printing apparatus, some of which attempt to heat a resistive element unattached to the head electrodes, are provided by U.S. Pat. Nos. 3,848,720 of Carlsen, PRESSURE SPRING FOR A THERMOPRINTER, issued Nov. 19, 1974, 3,984,844, of Tanno et al, THERMAL RECORDING APPARATUS, issued Oct. 5, 1976, 4,056,822 of Thornburg et al, LOW PROFILE SINGLE CHANNEL THERMAL ANALOG RECORDER, issued Nov. 1, 1977, 4,030,408 to Miwa, THERMAL PRINTER HEAD, issued June 21, 1977, 3,719,261 to Heinzer et al, PRINTING METHOD AND APPARATUS USING CONDUCTIVE FUSIBLE INK, issued Mar. 6, 1973, and an article by J. L. Mitchell and K. S. Pennington, ELECTRICAL AND MECHANICAL MECHANISM FOR THERMAL TRANSFER PRINTING, IBM Technical Disclosure Bulletin, Vol. 18, No. 8, January 1976, pp. 2693–4.

Despite the localized and relatively uniform heating provided by the arrangements shown in Montanari et al, arrangements of this type still lack the resolution required, particularly in relatively high speed applications. Further problems arise from the fact that the ink coated ribbon often cannot be reused with good results because of the destructive nature of the process in which the ink is melted and flowed onto the adjacent paper.

BRIEF DESCRIPTION OF THE INVENTION

Electrothermal printing apparatus in accordance with the invention employs a resistive ribbon in connection with thermally sensitive paper. The resistive ribbon is provided with a thin conductive layer on the surface of the ribbon adjacent the paper so that the tips of thin, conductive styli which contact the opposite surface of the ribbon can impart heating to a discrete, well defined and highly localized area of the ribbon. At the same time the ribbon is mounted so as to move with the paper in the same direction and at the same speed. In this manner the heated discrete areas of the ribbon remain in contact with the thermally sensitive paper after passing the styli for a selected period of time long enough to provide the desired degree of coloration of the paper. As a consequence adequate coloration can be provided using relatively low heating levels. At the same time, the ribbon is preferably formed into an endless loop and is cycled past the styli so as to be continuously reusable in heating the paper in response to energization of the styli. Ample time is allowed for the heated discrete areas of the ribbon to cool after separating from the paper before again cycling into contact with the paper adjacent the styli in preparation for further printing.

In one preferred arrangement according to the invention the endless ribbon is looped around and driven by a pair of spaced-apart rollers having their axes of rotation parallel to the axis of rotation of a platen for advancing a length of thermally sensitive paper. In this way at any given time a portion of the ribbon remains in contact with and moves with the advancing paper. In an alternative arrangement the endless ribbon is formed into the shape of a hollow cylinder rotatable about an axis parallel to the axis of rotation of the platen which advances the paper.

BRIEF DESCRIPTION OF THE DRAWING

The foregoing and other objects, features and advantages of the invention will be apparent from the following more particular description of preferred embodiments of the invention, as illustrated in the accompanying drawing, in which.

DETAILED DESCRIPTION

Figure 1:
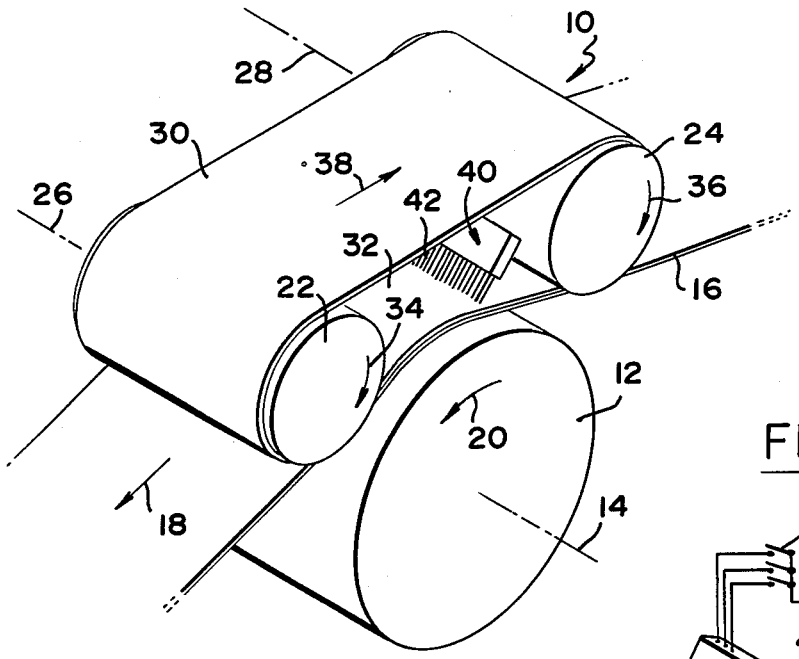
FIG. 1 is a perspective view of one arrangement of electrothermal printing apparatus in accordance with the invention.

FIG. 1 depicts an arrangement 10 of electrothermal printing apparatus in accordance with the invention. The arrangement 10 includes a cylindrical platen 12 rotatable about a central axis 14. A length of thermally sensitive print paper 16 is wound around part of the platen 12 so as to be advanced in the direction of an arrow 18 in response to rotation of the platen 12 in the direction of an arrow 20.

A pair of cylindrical rollers 22 and 24 mounted to rotate about central axes 26 and 28 respectively have an endless ribbon 30 wound thereabout. The rollers 22 and 24 are mounted in spaced-apart relation and so that the axes 26 and 28 are generally parallel to the axis of rotation 14 of the platen 12. The rollers 22 and 24 are disposed adjacent the platen 12 so as to dispose a portion 32 of the ribbon 30 which extends between the rollers 22 and 24 at the underside thereof in contact with the paper 16. Upon rotation of the rollers 22 and 24 in directions shown by the arrows 34 and 36 respectively, the ribbon 30 is caused to move in the direction of an arrow 38. It will be seen that the portion 32 of the ribbon 30 therefore moves in the same direction as the paper 16.

Rotation of the platen 12 and the rollers 22 and 24 is preferably controlled in such a way that the ribbon 30 moves in the same direction and at the same speed as the paper 16 so that the portion 32 of the ribbon 30 remains in surface-to-surface contact with the paper 16. For some applications, driving the platen 12 may be sufficient to rotate the rollers 22 and 24 and move the ribbon 30 without independent driving means through the frictional contact between the ribbon 30 and the paper 16. For still other applications, it may be desirable or necessary to drive one or both of the rollers 22 and 24 in addition to the platen 12 to keep the ribbon 30 moving in contact with the paper 16.

A styli assembly 40 is mounted between the rollers 22 and 24 and includes a row of styli 42 extending across a substantial portion of the width of the ribbon 30. As described hereafter individual ones of the styli 42 are momentarily energized by being temporarily coupled to a thin conductive layer on the outside of the ribbon 30 through a voltage source so as to heat a small discrete area of the ribbon 30. Each discrete area of the ribbon 30 as so heated remains in contact with an adjacent discrete area of the paper 16 during a predetermined period of time determined by the time it takes for the ribbon 30 to advance from the styli 42 to the roller 22 so as to discolor the discrete area of the thermally sensitive paper 16.

Figure 2:
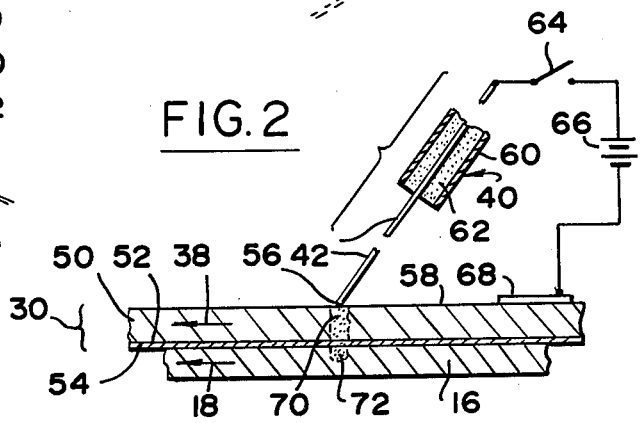
FIG. 2 is a sectional view of a portion of FIG. 1 illustrating the details of the resistive ribbon and contacting styli.

FIG. 2 depicts a portion of the arrangement 10 of FIG. 1 in cross-sectional view. As seen in FIG. 2, the ribbon 30 includes a relatively thin, generally planar layer 50 of resistive material having a thin, planar layer 52 of conductive material disposed on an outside surface 54 of the layer 50. The conductive layer 52 contacts the thermally sensitive paper 16 which is also of thin, planar configuration. Each of the styli 42 has a pointed tip 56 which contacts an inside surface 58 of the resistive layer 50. The styli assembly 40 includes an elongated, hollow housing 60 within which the various styli 42 are mounted using potting compound 62. A portion of each stylus 42 opposite the pointed tip 56 is coupled through a switch 64 and a voltage source 66 to the conductive layer 54. Since the ribbon 30 moves relative to the styli assembly 40, a conductive path between the voltage source 66 and the conductive layer 54 is provided by appropriate means such as a sliding contact 68 shown in FIG. 2. The contact 68 is made relatively large so as not to heat the adjacent area of the resistive layer 50 to a very high temperature so as to discolor the adjacent area of the paper 16, and is omitted from FIG. 1 for clarity. Alternatively, one or both of the rollers 22 and 24 of the arrangement of FIG. 1 can be grounded to complete the styli circuits. The voltage source 66 and the sliding contact 68 are common to all of the styli 42. However, each stylus 42 is coupled to the voltage source 66 through a different one of the switches 64 so as to be separately and independently coupleable to the voltage source 66.

Whenever one of the switches 64 is momentarily closed, a circuit is completed from one side of the voltage source 66 through the stylus 42, the adjacent portion of the resistive layer 50, a portion of the conductive layer 52, a portion of the resistive layer 50 and the sliding contact 68 to the other side of the voltage source 66. The resistive layer 50 has a small, controlled amount of conductivity so as to complete the circuit between the pointed tip 56 and the conductive layer 52 but is basically resistive so as to experience heating. A resulting heated area 70 is shown in FIG. 2. The conductive layer 52 is sufficiently thin so that heat from the discrete area 70 of the resistive layer 50 flows to an adjacent discrete area 72 of the thermally sensitive paper 16. This causes the paper 16 to discolor at the discrete area 72, thereby printing a dot on the paper 16. Since the paper 16 moves with the ribbon 30 as the ribbon 30 moves past the stylus 42 the heated discrete area 70 of the resistive layer 50 remains in contact with the discrete area 72 of the paper 16 until the roller 22 is reached at which point the ribbon 30 separates from the paper 16. Up to that point heat from the discrete area 70 of the resistive layer 50 continues to develop the discrete area 72 of the paper 16, so that only a relatively small amount of heat need be generated within the resistive layer 50 to provide thorough coloration of the discrete area 72 of the paper 16. When the roller 22 is reached, the ribbon 30 separates from the paper 16, allowing the ribbon 30 to cool in preparation for the next pass in which the ribbon 30 passes over the roller 24 and is heated by the styli 42. Because only a relatively small amount of heat is required to color the paper 16, each stylus 42 is able to terminate in the pointed tip 56 so as to heat only a relatively small area of the resistive layer 50.

Figure 3:
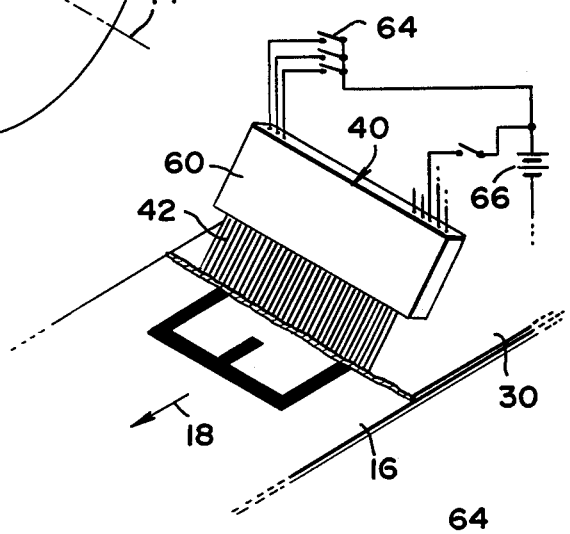
FIG. 3 is a perspective view of the styli assembly of the apparatus of FIG. 1 illustrating the manner in which printing may be effected in dot matrix fashion.

The manner in which the arrangement 10 of FIG. 1 prints in dot matrix fashion is shown in FIG. 3 which depicts the styli assembly 40 together with a portion of the paper 16 and a portion of the ribbon 30. The ribbon 30 is broken away at the styli 42 so as to reveal the portion of the paper 16 immediately downstream of the styli 42. The length of the row of styli 42 is at least equal to the height of a line of characters so that the line of characters can be printed in a single movement or sweep of the paper 16 in the direction of the arrow 18 relative to the styli assembly 40. Each stylus 42 can be energized momentarily to print a dot or can be energized continuously to print a line. Thus, the "E" shown in FIG. 3 can be printed by at first energizing most of the styli 42 for at least several dot positions to print the back or vertical portion of the letter, following which three small groups of the styli 42 continue to be energized to the exclusion of the other styli to print the three legs of the letter.

Figure 4:
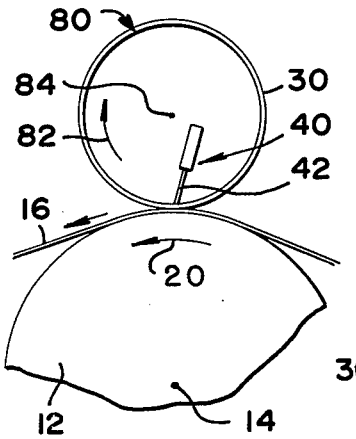
FIG. 4 is a side view of an alternative arrangement of electrothermal printing apparatus in accordance with the invention.

FIG. 4 depicts an alternative arrangement which is like that of FIG. 1 except that the endless ribbon 30 is formed into the shape of a hollow cylinder 80 which contacts the paper 16 opposite the platen 12. The cylinder 80 is mounted for rotation in the direction shown by an arrow 82 about a central axis 84 parallel to the axis 14 of the platen 12. The cylinder 80 is preferably mounted at the opposite ends thereof so as to leave the hollow interior thereof unobstructed so that the styli assembly 40 may reside therein.

The arrangement shown in FIG. 4 is somewhat simpler than the arrangement 10 of FIG. 1 and may be used in situations where it is not necessary to maintain the heated discrete areas of the ribbon 30 in contact with the paper 16 for very long to properly develop the paper 16. At the same time, rotation of the cylinder 80 allows the heated areas of the ribbon 30 to cool during each revolution prior to passage under the styli 42. If a longer contact time between the ribbon 30 and the paper 16 is needed, the embodiment of FIG. 1 can be used or the embodiment of FIG. 4 can be modified such as by making the platen 12 of resilient material so as to create a depression under the styli 42 providing for longer contact.

As noted above the resistive layer 50 of the ribbon 30 is essentially electrically resistive in nature but has a small, predetermined amount of conductivity present to allow the electrical circuits to be completed between the styli 42 and the conductive layer 52. This may be accomplished by forming the resistive layer 50 from a mixture of an insulative material which is polycarbonate or polyimide and a material such as carbon. One suitable polycarbonate ribbon is described and claimed in commonly assigned U.S. Pat. No. 4,103,066 to Brooks et al. A polyimide ribbon can be made by similar techniques. Good results have been obtained using carbon black in both polycarbonate and polyimide. When materials of this type are used, the resistive layer 50 preferably has a thickness in the range of 5–22 microns to provide high resolution on the order of about 250 pels/inch. Thicknesses substantially greater than this lower the resolution because of the spreading effect of the heating through the thickness thereof and require larger voltages. Resistive layers having thicknesses substantially lower than this become structurally unstable as well as unable to hold heat.

The conductive layer 52 can have a thickness within the range of 0.02–25 microns depending among other things on the material used. Aluminum has been found to be ideally suited for this layer 52, particularly at the thinner portion of the range. At relatively thick portions of the range less conductive materials such as stainless steel may be preferable. For a given material conductivity, if the conductive layer 52 is made too thick the heat spreads excessively and resolution is lost. Conversely, if the layer 52 is too thin it will not have the necessary electrical conductivity.

The styli 42 preferably comprise material such as tungsten which is both conductive and resistive to abrasion by the ribbon 30. In a preferred arrangement of a styli assembly 40 according to the invention, the styli 42 comprise tungsten wires 1.5 mils in diameter and held 4 mils apart, center-to-center, by a potting compound 62 consisting of silicon rubber.

As previously noted electrothermal printing arrangements in accordance with the invention improve upon resolution by enabling very small and precisely defined discrete areas of the paper to be adequately colored using relatively small voltages. Thus, for a given paper speed, resolution is greatly improved over that which is possible in prior art arrangements operating at the same paper speed. Conversely, the paper speed can be increased for a given resolution when compared with prior art arrangements. Arrangements in accordance with the invention have enabled the paper speed to be increased from approximately 3" per second to speeds of as much as 10" per second or more in systems were characters are printed at a density of about 10 characters per inch without loss in resolution.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A thermal printing arrangement comprising the combination of a thin, electrically resistive element, thermally sensitive printable media disposed in adjacent, heat transfer relation with the resistive element, circuit means for applying a potential difference across discrete areas of the thickness of the resistive element, the resistive element heating at the discrete areas in response to the potential difference and the thermally sensitive printable media undergoing changes in the coloration thereof at discrete areas adjacent the discrete areas of the resistive element in response to said heating, means for moving the printable media and means for moving the resistive element together with the printable media while printing so that a portion of the resistive element having heated discrete areas remains in adjacent, heat transfer relation with the printable media for a selected period of time as the printable media moves.

2. The invention set forth in claim 1, wherein the printable media comprises paper which discolors in response to heat.

3. The invention set forth in claim 1, wherein the printable media moves at a given speed and in a given direction and the means for moving the resistive element is operative to move a portion of the resistive element at the given speed and in the given direction so that the portion of the resistive element is in surface-to-surface contact with the printable media for the selected period of time.

4. The invention set forth in claim 1, wherein the circuit means includes a thin conductive layer mounted on a surface of the resistive element adjacent the printable media and at least one elongated, conductive element having a pointed end in contact with the resistive element opposite the conductive layer.

5. The invention set forth in claim 4, wherein the conductive element contacts said portion of the resistive element and the resistive element moves relative to the conductive element.

6. A thermal printing arrangement comprising at least one conductive stylus having a tip at one end thereof, a relatively thin, generally planar, electrically resistive layer disposed in contact with and movable at a selected speed relative to the tip of the stylus, a relatively thin, generally planar, electrically conductive layer mounted on the side of the resistive layer opposite the stylus, a voltage source coupled between the stylus and the conductive layer, means for moving together a thermally sensitive printable medium adjacent the conductive layer at the selected speed, and means for selectively energizing said at least one conductive stylus as said printable medium moves.

7. The invention set forth in claim 6, wherein the means for moving a printable medium adjacent the conductive layer includes a generally cylindrical roller rotatable about an axis and having an outer surface positioned to engage and move a printable medium.

8. The invention set forth in claim 7, wherein the resistive layer and the conductive layer together comprise an endless ribbon of generally uniform width, and further including an opposite pair of circular, rotatable elements disposed adjacent the outer surface of the roller and mounting opposite portions of the ribbon for movement in response to rotation of the rotatable elements about axes generally parallel to the axis of the roller, the stylus being disposed between the pair of circular, rotatable elements and adjacent the roller.

9. The invention set forth in claim 7, wherein the resistive layer and the conductive layer are formed into the shape of a hollow cylinder with the resistive layer on the inside and the conductive layer on the outside, the hollow cylinder being disposed adjacent the outer surface of the roller and rotatable about an axis generally parallel to the axis of the roller, the stylus being disposed within the hollow cylinder at a point adjacent the roller.

10. The invention set forth in claim 6, further comprising a plurality of conductive styli, each having a tip at one end thereof, the tips contacting the resistive layer and being spaced apart along an axis generally normal to a direction of movement of the resistive layer.

11. The invention set forth in claim 6, wherein the resistive layer is 5–22 microns thick and is comprised of a mixture of polycarbonate and carbon.

12. The invention set forth in claim 6, wherein the resistive layer is 5–22 microns thick and is comprised of a mixture of polyimide and carbon.

13. The invention set forth in claim 6, wherein the conductive layer is 0.02–25 microns thick and is made of aluminum.

14. The invention set forth in claim 6, wherein the stylus comprises a tungsten wire approximately 1.5 mils in diameter.

* * * * *